US005646365A

United States Patent [19]

Collier

[11] Patent Number: 5,646,365

[45] Date of Patent: *Jul. 8, 1997

[54] BULLET IDENTIFICATION

[76] Inventor: William E. Collier, 1601 S. Brand Blvd., Glendale, Calif. 91204

[ * ] Notice: The term of this patent shall not extend beyond the expiration date of Pat. No. 5,485,789.

[21] Appl. No.: 557,689

[22] Filed: Nov. 13, 1995

Related U.S. Application Data

[63] Continuation of Ser. No. 309,257, Sep. 20, 1994, Pat. No. 5,485,789, which is a continuation-in-part of Ser. No. 183, 078, Jan. 18, 1994, abandoned.

[51] Int. Cl.[6] ..... F42B 12/00

[52] U.S. Cl. ..... 102/501; 102/517

[58] Field of Search ..... 102/430, 439, 102/473, 501, 507–510, 513–518

[56] References Cited

U.S. PATENT DOCUMENTS

| | | | |
|---|---|---|---|
| 3,749,016 | 7/1973 | Hershkowitz | 102/517 |
| 3,758,970 | 9/1973 | Annenberg . | |
| 3,893,111 | 7/1975 | Cotter . | |
| 3,931,688 | 1/1976 | Owens . | |
| 3,948,263 | 4/1976 | Drake, Jr. et al. . | |
| 4,005,660 | 2/1977 | Pichard | 102/501 |
| 4,065,753 | 12/1977 | Paul, Jr. . | |
| 4,098,014 | 7/1978 | Lauer et al. . | |
| 4,114,032 | 9/1978 | Brosow et al. . | |
| 4,150,624 | 4/1979 | Hammond . | |
| 4,184,700 | 1/1980 | Greenaway . | |
| 4,218,674 | 8/1980 | Brosow et al. . | |
| 4,222,330 | 9/1980 | Krystyniak . | |
| 4,318,554 | 3/1982 | Anderson et al. . | |
| 4,330,350 | 5/1982 | Andrews . | |
| 5,485,789 | 1/1996 | Collier | 102/501 |

FOREIGN PATENT DOCUMENTS 1240760 5/1967 Germany .

OTHER PUBLICATIONS

Colco Press Release; Mar. 25, 1994; pp. 1–2.

Scott Holleran; *Bike shop owner creates bullet with a name on it;* Glendale News–Press; May 5, 1994; pp. A–1 and A12.

Scott Holleran; *A bullet with your name on it;* Los Angeles Times; May 8, 1994; p. 3.

Timothy Williams; *This bullet Has the Gunman's Name on it;* Los Angeles Times; Jun. 15, 1994; p. B2.

Citizens Legal Defense Alliance Press Release; May–Jun. 1994; pp. 1–4.

Angela Phipps; *Invent;* Glendale News–Press; Sep. 5, 1994; p. A4.

Angela Phipps; *Local inventor wins award for patented bullet;* Glendale News–Press; p. A1 Sep. 10–11, 1994.

Colco brochure; *Identifiable Collier Bullet;* Oct. 17, 1994.

*Primary Examiner*—Harold J. Tudor

*Attorney, Agent, or Firm*—Wells, St. John, Roberts, Gregory & Matkin, P.S.

[57] ABSTRACT

The present invention relates to an identifiable bullet and method for identifying such bullets. The bullet comprises a bullet jacket, a lead core and an identification tag in the lead core. In one embodiment, the identification tag is an identification section including a core and an outer protective coating. The core and outer coating are heat-resistant and flexible to prevent damage when the bullet is discharged from a firearm. The identification segment is, in one embodiment, mounted within a chamber formed at the rear end of a main projectile portion, after which a plug or end cap is positioned to hold the identification section in place and protect the identification section from damage. The chamber may comprise one or more annular grooves in which the identification section and/or the end cap extends and engages to securely hold the respective components in place.

27 Claims, 4 Drawing Sheets

BULLET IDENTIFICATION

RELATED APPLICATIONS

This is a continuation of prior U.S. patent application Ser. No. 08/309,257 filed Sep. 20, 1994, which is U.S. Pat. No. 5,485,789, which is a continuation-in-part of my prior U.S. patent application Ser. No. 08/183,078, filed Jan. 18, 1994, now abandoned.

TECHNICAL FIELD

The present invention relates to a means for identifying individual bullets.

BACKGROUND OF THE INVENTION

Over the past several years there has been increasing concern over the availability and use of firearms in society and the resultant increase in violence. These concerns have led to the introduction of legislation to limit access to firearms or for the registration and identification of such firearms.

However, identification relating to firearm does not often lead to an identification of the firearm used in a violent crime since the firearm may not be left at the scene or may not be recovered. Therefore, the connection between the firearm used and the owner of the firearm cannot be made. In addition, even if the firearm is recovered it may have been stolen and identification of the firearm does not produce the user of the firearm. Also stolen firearms can be altered easily to remove forms of identification.

Therefore, to make identification of users of firearms more likely there is a need for a means of tying the user of a firearm to a crime scene. The means should be inexpensive, easy to implement and not easily removed.

Attempts have been made to provide identification means in bullets. However, such prior attempts at bullet identification have been difficult to incorporate into a bullet, have been subject to damage upon discharging the bullet from a firearm, and are difficult to recover from a discharged bullet.

Still another difficulty with respect to bullet identification systems is the susceptibility to fraud and counterfeiting. Traditional identification systems fail to even address this problem. Accordingly, it is possible for persons desiring to circumvent the bullet identification system by producing counterfeit bullets. A system is therefore needed to preserve and maintain the integrity of an identification system. This would be particularly important if bullet registration is required by law in the future.

SUMMARY OF THE INVENTION

The present invention relates to an identifiable bullet and method for identifying such bullets. The bullet comprises a bullet jacket, a lead core and a means of identification in the lead core. The means for identification comprises an imprint on a heat resistant material.

The method of the present invention comprises placing an identification tag into a bullet, packaging the bullet into a container. The container includes an identification code which corresponds to the identification code on the identification tag of the bullet included in the container. The catalog is formed which comprises the identification tag code and the name of the purchaser of the bullet. A spent bullet is retrieved and the identification tag is retrieved from the spent bullet. The identification tag code on the retrieved identification tag is matched with the identification tag code in the catalog to thereby identify the purchaser of the bullet.

Another aspect of the present invention involves a main projectile portion of a bullet having a front nose portion and a first rear wall, with a chamber extending rearwardly beyond the main wall. The chamber allows an identification section to be installed into the chamber, after which a plug is inserted to maintain the identification section in place and protect it from damage after the projectile portion has been discharged from a firearm. Still another aspect of the present invention involves an identification section comprising a core that is marked with an indicia and a protective coating surrounding the core.

Still another aspect of the present invention involves a color coding scheme whereby the core of the identification section may be made of one particular color, and the outer coating comprises a different color. In addition, the end cap or plug may comprise a particular color to add to the potential color schemes for prevention of counterfeiting. The color schemes are matched with the indicia printed on the core to prevent counterfeiting of the bullet identification system.

Other objects, features, and advantages of the invention will become more apparent from the detailed disclosure that follows.

BRIEF DESCRIPTION OF THE DRAWINGS

Preferred embodiments of the invention are described below with reference to the accompanying drawings, which are briefly described below.

These and other features and advantages of the present invention will be better understood by reference to the following detailed description when considered in conjunction with the accompanying drawings in which.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The present invention involves a means for identifying bullets. The means of identification comprises an identification tag which includes a number or code. The number or code on the tag can be cataloged with the name of the purchaser so that when the identification tag is retrieved from a spent bullet it can be used as a means of identifying the purchaser of the bullet and, presumably, the person who fired the bullet. While a firearm may not be left at a crime scene, bullets usually are, therefore, identification of the bullet makes a link to the purchaser of the bullet.

Figure 1:
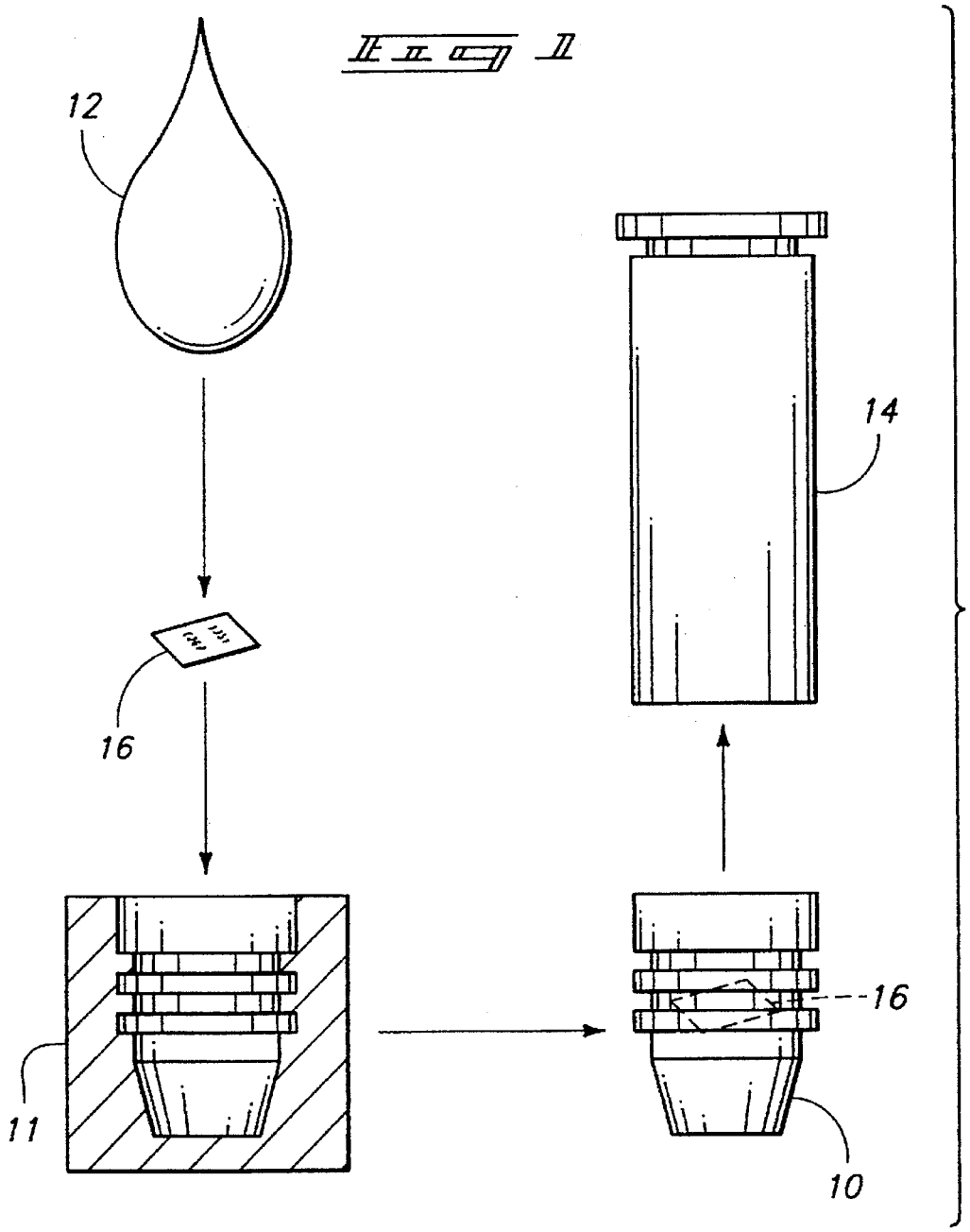
FIG. 1 is a schematic view of one embodiment of a bullet according to the present invention.
Figure 2:
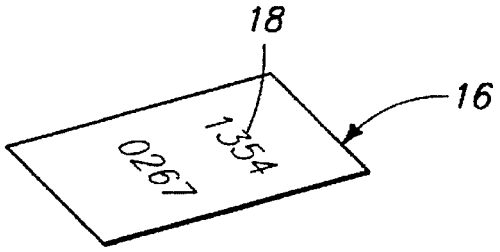
FIG. 2 is a schematic view of an identification tag.

Bullets are manufactured in a die 11 to form a jacket 10 of a metal such as copper. The jacket is filled with molten lead 12. Once the lead has hardened, powder and an casing 14 (see FIG. 1) are placed over the end of the bullet. In the practice of the present invention an identification tag 16 is placed inside the bullet during manufacture, while the lead is still molten. The identification tag is prepared from a material such as: a metal such as copper, tin, aluminum or stainless steel; a plastic such as NOMEX® or KEVLAR® (both supplied by DuPont of Wilmington, Del.); or other suitable thermal resistant materials which are capable of holding and retaining a number or code and which can withstand the temperature of the molten lead, about 330° C. The material may be in the form of a sheet, disc, cylinder, ball or other suitable form. In the case of plastics a plastic fiber can be woven into a fabric.

For use in the present invention the material of the identification tag is imprinted with an identification number or code. On metals or plastics the number or code may be etched or engraved, on fabrics the number or code may be printed. The methods of etching, engraving or printing are well known in the art and any of the techniques known for imprinting which are suitable for the material chosen may be used.

The size of the identification tag onto which the identification number or code is imprinted is dictated by the size of the bullet into which the identification tag is to be inserted. The identification tag must be small enough to fit within the jacket of the bullet.

In another embodiment of the present invention the identification tag comprises a chemical label. In this embodiment different chemicals are mixed in different proportions. The combination of chemicals are unique for the bullets in which they are included. These chemicals are added to the molten lead. After retrieval of a spent bullet a sample of the lead is analyzed to identify the bullet. In this embodiment of the invention the method of analysis comprises performing a spectra of the lead sample or other chemical analysis means suitable for identifying the type or proportions of the chemicals used as the identification code. Such methods of chemical analysis are well known in the art.

Once the material is inserted into the bullet jacket the manufacture of the bullet is completed in the conventional manner. The bullets are then packaged. To minimize the labor involved in cataloging the identification numbers or codes with the bullets, bullets are sold in a minimum sale lot, of for example 50 bullets, which are packaged in a single packaging. All the bullets included in the packaging have the same identification number or code. A bar code or other "machine readable" code is placed on the exterior of the package. The code identifies the identification code used for the bullets included in the packaging. This allows easy input of the data into a computer by scanning the bar code on the exterior of the package with a conventional scanner and storing the accumulated data directly in a computer. The use of the bar code also reduces errors in inputing the data. The seller of the bullets then only has to input the name or other forms of identification for the purchaser. The data in the computer is then available for later retrieval and use to identify bullets recovered from a crime scene or wherever spent bullets are found.

For identification of a bullet at a crime scene, the remains of any bullet are recovered and the identification tag removed from the remains of the bullet. This can easily be done by heating the lead core of the bullet with a blow torch, or other suitable heating device, to melt the lead. The identification tag, which is of a thermal resistant material, remains intact and is retrieved from the molten lead. The number or code on the identification tag is then read and input into the computer to retrieve the name or identity of the purchaser of the bullets.

EXAMPLE 1

The caps of 30 45-caliber bullets were removed and the lead cores of the bullets melted. Stainless steel sheets or stainless steel ball bearings were used as identification tags. In all 30 of the bullets stainless steel ball bearings were placed in the molten lead of the bullets. The caps were replaced in the bullets. The bullets were fired from a gun into telephone books. Each of the spent bullets was recovered.

Fourteen of the recovered bullets were deformed from the impact and 12 bullets were fragmented. The lead from each of the bullets was separately melted and the stainless steel sheets or stainless steel ball bearings were recovered from the molten lead. In all cases the recovered identification tag was found to be intact and 100% recovery of the identification tag contained in the bullets was achieved.

Alternative Embodiments

Another aspect of the present invention involves an identifiable bullet, comprising a main projectile portion having a front nose portion and a first rear wall opposite the front nose portion;

a chamber extending from the first rear wall;

an identification section mounted within the chamber adjacent the first rear wall of the main projectile portion having indicia affixed thereon for identification of the projectile portion after being discharged from a firearm; and a plug mounted within the chamber adjacent the identification section to secure and maintain the identification section within the chamber and protect the identification section from damage after the projectile portion has been discharged from a firearm.

Figure 3:
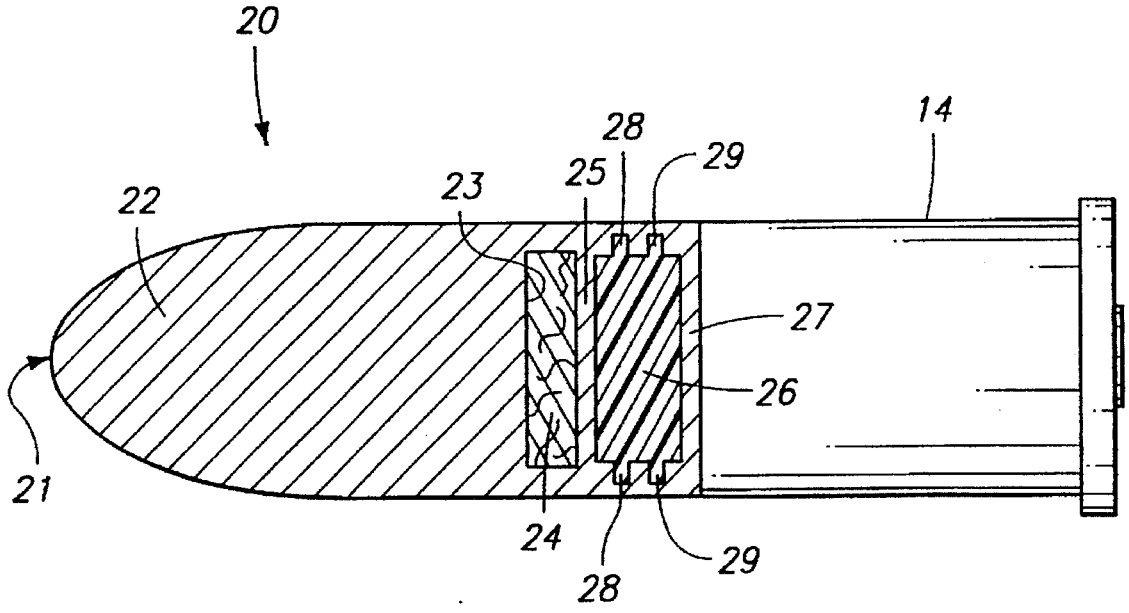
FIG. 3 is a partial sectional side elevation view of another embodiment of a bullet according to the present invention.

FIG. 3 discloses an alternative embodiment of an identifiable bullet 20 according to the present invention. The bullet includes a main projectile portion 22 having a cortically shaped front nose portion 21 and a first rear wall 23 opposite the front nose portion. A chamber 24 extends rearwardly beyond the first rear wall 23. In this particular embodiment, an identification section is disposed inside the first chamber. A second rear wall 25 seals the identification section 24 into the first chamber. Extending rearwardly from the second rear wall 25 is a second chamber in which a plug or end cap 26 is disposed. With reference still to FIG. 3, the chamber in which the plug 26 is disposed includes a pair of annular grooves 28, 29 extending radially outward from the chamber. The plug extends into and engages the grooves to anchor the plug in position. A third and final end wall 27 seals the combined identification section 24 and plug 26 against the second rear wall 25 and main end wall 23, respectively, of the bullet 20.

Figure 4:
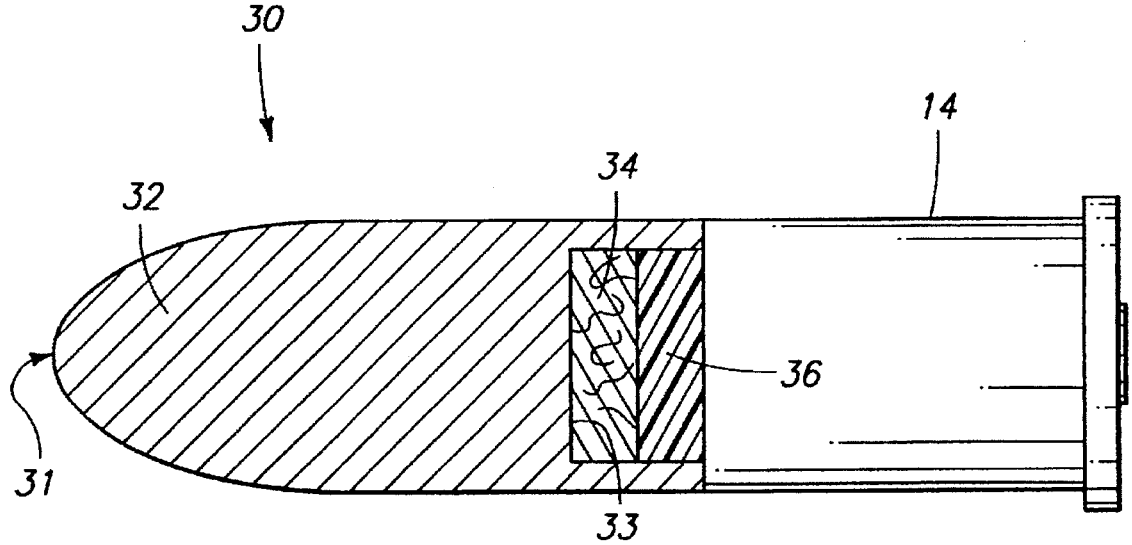
FIG. 4 is a partial sectional side elevation view of still another embodiment of a bullet according to the present invention.

FIG. 4 discloses another alternative embodiment of the present invention. An identifiable bullet 30 comprises a main projectile portion 32 having a cortically shaped front nose portion 31 at one end and terminating at a first rear wall 33 at an opposite end. The first rear wall defines a chamber in which an identification section 34 is first inserted. A plug 36 is thereafter inserted to hold the identification section in place and protect it from damage. The embodiment of FIG. 4 is particularly suitable for manufacturing because the main projectile portion 32 can be manufactured before the identification section and the plug are installed therein.

Figure 5:
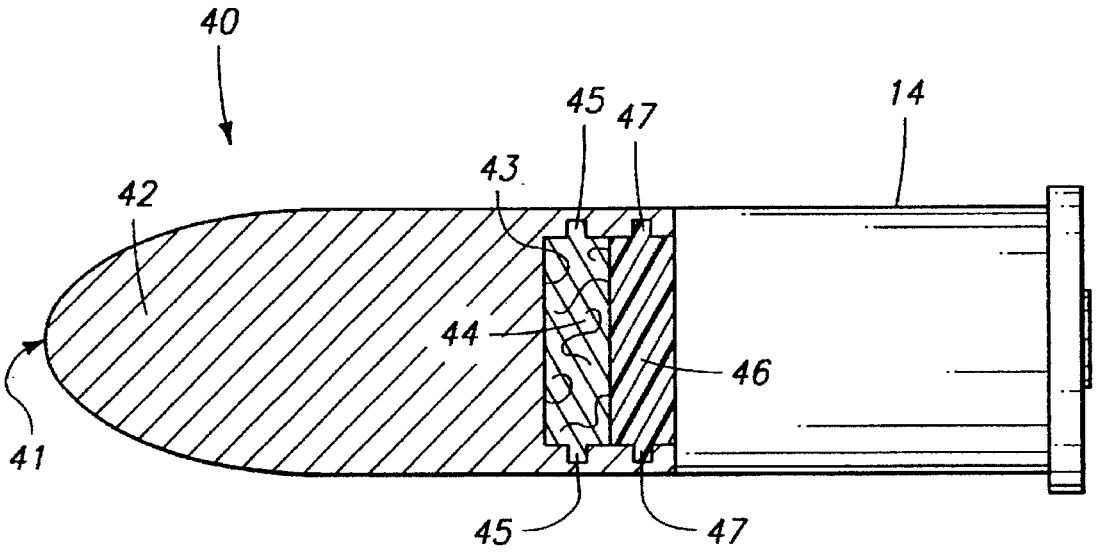
FIG. 5 is a partial sectional side elevation view of yet another embodiment of a bullet according to the present invention.

FIG. 5 shows still another embodiment of the present invention which includes a bullet 40 including a main projectile portion 42 having a conically shaped front nose portion 41 at one end and a first rear wall 43 at an opposite end. A chamber is formed rearwardly of first rear wall of the main projectile portion. An identification section 44 is mounted within the chamber, after which a plug or end cap 46 is inserted and secured to the chamber walls. The chamber defines a first annular groove 45 and a second annular groove 47 in which the identification section 44 and end cap 46 are respectively retained.

Figure 6:
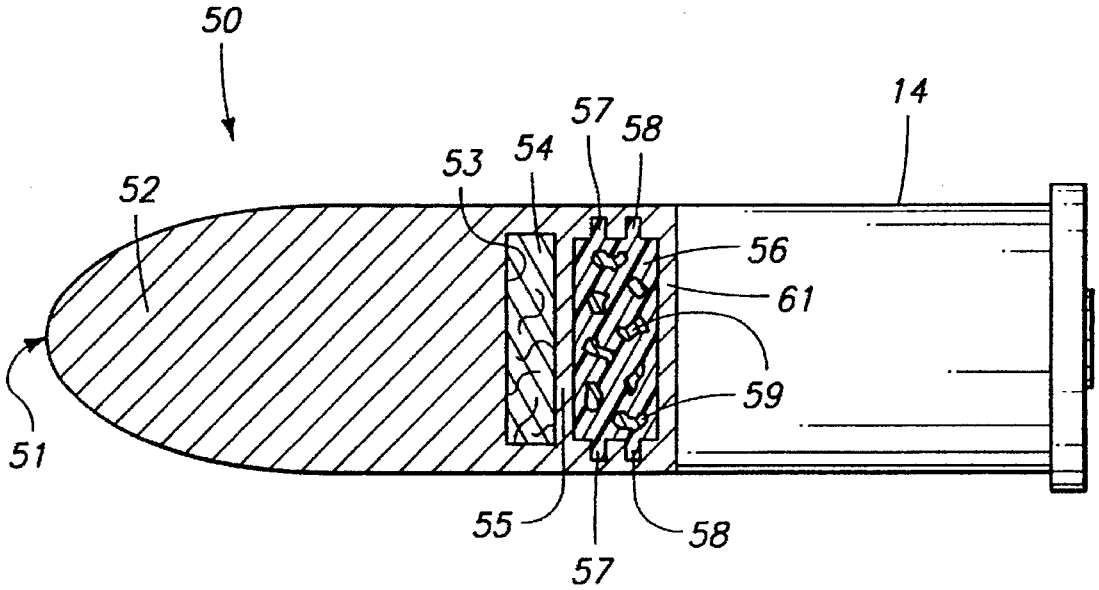
FIG. 6 is a partial sectional side elevation view of another embodiment of a bullet according to the present invention.

FIG. 6 discloses yet another embodiment of the present invention. A bullet 50 comprises a main projectile portion 52 including a conically shaped front nose portion 51 at one end and a first rear wall 53 at an opposite end. A first chamber is formed rearward of the first end wall 53. An identification section 54 is mounted within the first chamber. A second rear wall 55 divides the first chamber, which holds the identification section 54, from a second chamber which holds an end cap or plug section 56. The second chamber defines a pair of annual grooves 57, 58. The plug extends into and engages the grooves to retain the plug in place against the second rear wall 55. A third rear wall 61 encloses the plug within the second chamber.

In instances where the weight and balance of the bullet 50 needs to be adjusted, the plug section 56 may include fragments of metal or other suitable weighted particles 59 to balance the weight of the bullet.

Figure 7:
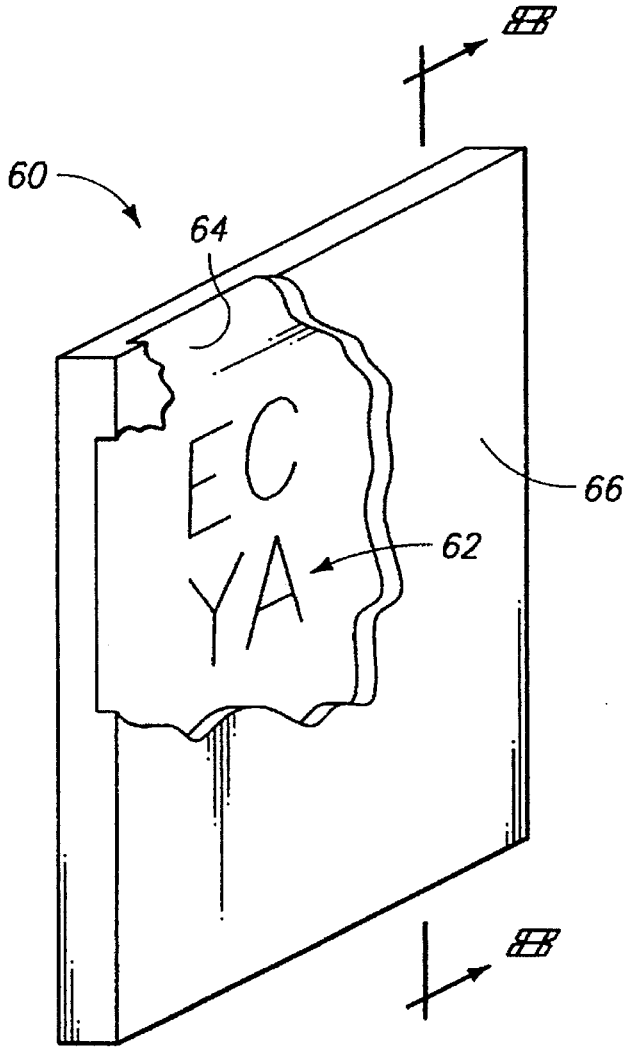
FIG. 7 is a perspective view, partly broken away, of an identification section to be incorporated into a bullet according to the present invention.
Figure 8:
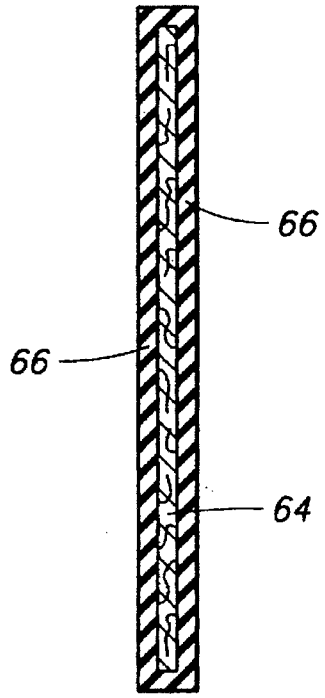
FIG. 8 is a sectional view, taken along the line 8—8 of FIG. 7, of the identification section.

FIG. 7 shows one embodiment of an identification section 60, which has been partially broken away. The identification section 60 includes a core 64 to which indicia 62 are affixed. The core is preferably made of a flexible, resilient, heat-resistant fabric, such as KEVLAR®, NOMEX®, or any other suitable identification material.

The core 64 is protected by an outer protective coating or layer 66. The layer 66 may comprise a rubber or plastic material, or any other material suitable for protecting the core 64. The combined core and outer coating should preferably be flexible so that it is not destroyed or fragmented upon impact of the bullet after being discharged from a firearm. In addition, these materials should be heat-resistant to withstand the intense heat to which these elements are subjected upon discharging the bullet from a firearm.

The core 64 and the outer coating 66 preferably comprise particular colors to establish a color scheme whereby the indicia of the identifiable bullets can be matched with the color scheme to prevent counterfeiting. In addition, the end cap or plug 26, 36, 46, 56 may also comprise a particular color to further establish a color scheme to prevent counterfeit bullets from being manufactured. Any number of color schemes may be used in combination with the indicia on the identification section for anti-counterfeiting purposes.

In each of the embodiments of FIGS. 3–6, the identification sections 24, 34, 44, 54 may comprise a heat-resistant fabric, such as KEVLAR® or NOMEX®, or any other suitable identification material. Alternatively, a micro chip may be imbedded in the respective chambers or a plurality of micro dots may be used in combination with the present identification section. The plug or filler cap may be made of plastic, silicon, epoxy, or any other suitable material to protect the identification section 24 from damage after the bullet has been discharged from a firearm. With respect to marking the identification section, any suitable means, such as laser printing, chemical treatment, or any other suitable marking system may be used.

The present invention is not to be limited to the specific embodiments shown which are merely illustrative. Various and numerous other embodiments may be devised by one skilled in the art without departing from the spirit and scope of this invention. The scope of the invention is defined in the following claims.

I claim:

1. An identifiable bullet, comprising:

a main projectile portion having a front nose portion and a first rear wall opposite the front nose portion;

a chamber extending from the first rear wall;

an identification section mounted within the chamber adjacent the first rear wall of the main projectile portion having indicia affixed thereon for identification of the projectile portion after being discharged from a firearm; and a plug mounted within the chamber adjacent the identification section to help secure and maintain the identification section within the chamber and protect the identification section from damage;

said plug and main projectile portion being constructed with features which engage with one another so as to resist relative motion of the plug forward toward the identification section and front nose portion of the main projectile.

2. An identifiable bullet according to claim 1 wherein the chamber is substantially cylindrical shaped, and further comprising at least one annular groove extending radially outward of the chamber, the plug extending into and interlocking with the at least one annular groove.

3. An identifiable bullet according to claim 1 wherein the chamber is substantially cylindrical shaped, and further comprising at least one annular groove extending radially outward of the chamber, the identification section extending into and interlocking with the at least one annular groove.

4. An identifiable bullet according to claim 1 wherein the chamber is substantially cylindrical shaped, and further comprising a pair of annular grooves extending radially outward of the chamber, the plug extending into and interlocking with one of the grooves, the identification section extending into and interlocking with the other of the grooves.

5. An identifiable bullet according to claim 1 wherein the chamber is substantially cylindrical shaped, and further comprising a pair of annular grooves extending radially outward of the chamber, the plug extending into and interlocking with each of the grooves.

6. An identifiable bullet according to claim 1 wherein the identification section comprises a first color, the first color and the indicia comprising a combined coding system.

7. An identifiable bullet according to claim 1 wherein the identification section comprises a core on which the indicia is affixed, and an outer coating encapsulating the core, the core comprising a first color, the outer coating comprising a second color, the first color, the second color, and the indicia comprising a combined coding system.

8. An identifiable bullet according to claim 1, further comprising a second rear wall disposed between the identification section and the plug.

9. An identifiable bullet according to claim 1 wherein the plug includes a plurality of metal fragments for providing additional weight toward the rear end of the main projectile portion.

10. An identifiable bullet, comprising:

a main projectile portion having a front nose portion and a first rear wall opposite the front nose portion;

a chamber extending rearwardly beyond the first rear wall;

an identification section mounted within the chamber adjacent the first rear wall of the main projectile portion, the identification section comprising a core having an indicia affixed thereon, and an outer coating encapsulating the core to protect the core and preserve the indicia affixed thereon;

a plug mounted within the chamber to help maintain the identification section within the chamber and protect the identification section from damage.

11. An identifiable bullet according to claim 10 wherein the chamber is substantially cylindrical shaped, and further comprising at least one annular groove extending radially outward of the chamber, the plug extending into and interlocking with the at least one annular groove.

12. An identifiable bullet according to claim 10 wherein the chamber is substantially cylindrical shaped, and further comprising at least one annular groove extending radially outward of the chamber, the identification section extending into and interlocking with the at least one annular groove.

13. An identifiable bullet according to claim 10 wherein the chamber is substantially cylindrical shaped, and further comprising a pair of annular grooves extending radially outward of the chamber, the plug extending into and interlocking with one of the grooves, the identification section extending into and interlocking with the other of the grooves.

14. An identifiable bullet according to claim 10 wherein the chamber is substantially cylindrical shaped, and further comprising a pair of annular grooves extending radially outward of the chamber, the plug extending into and interlocking with each of the grooves.

15. An identifiable bullet according to claim 10 wherein the identification section comprises a first color, the first color and the indicia comprising a combined coding system.

16. An identifiable bullet according to claim 10, further comprising a second rear wall disposed between the identification section and the plug.

17. An identifiable bullet according to claim 10 wherein the plug includes a plurality of metal fragments for providing additional weight toward the rear end of the main projectile portion.

18. An identifiable bullet, comprising:

a main projectile portion having a front nose portion and a first rear wall opposite the front nose portion;

an identification section mounted inside the main projectile portion, the identification section comprising a core having an indicia affixed thereon, and an outer coating encapsulating the core to protect the core and preserve the indicia affixed thereon.

19. An identifiable bullet according to claim 18 wherein the core comprises a first color, the first color and the indicia comprising an identification system.

20. An identifiable bullet, comprising:

a main projectile portion having a front nose portion and a first rear wall opposite the front nose portion;

a chamber extending from the first rear wall;

an identification section mounted within the chamber adjacent the first rear wall of the main projectile portion having indicia affixed thereon for identification of the projectile portion after being discharged from a firearm;

a plug mounted within the chamber adjacent the identification section to secure and maintain the identification section within the chamber and protect the identification section from damage; and a second rear wall disposed between the identification section and the plug.

21. An identifiable bullet according to claim 20 wherein the chamber is substantially cylindrical shaped, and further comprising at least one annular groove extending radially outward of the chamber, the plug extending into and interlocking with the at least one annular groove.

22. An identifiable bullet according to claim 20 wherein the chamber is substantially cylindrical shaped, and further comprising at least one annular groove extending radially outward of the chamber.

23. An identifiable bullet according to claim 20 wherein the chamber is substantially cylindrical shaped, and further comprising a pair of annular grooves extending radially outward of the chamber.

24. An identifiable bullet according to claim 20 wherein the chamber is substantially cylindrical shaped, and further comprising a pair of annular grooves extending radially outward of the chamber, the plug extending into and interlocking with each of the grooves.

25. An identifiable bullet according to claim 20 wherein the identification section comprises a first color, the first color and the indicia comprising a combined coding system.

26. An identifiable bullet according to claim 20 wherein the identification section comprises a core on which the indicia is affixed, and an outer coating encapsulating the core, the core comprising a first color, the outer coating comprising a second color, the first color, the second color, and the indicia comprising a combined coding system.

27. An identifiable bullet according to claim 20 wherein the plug includes a plurality of metal fragments for providing additional weight toward the rear end of the main projectile portion.

* * * * *